US005707693A

United States Patent [19]

Vliet et al.

[11] Patent Number: 5,707,693

[45] Date of Patent: Jan. 13, 1998

[54] METHOD AND APPARATUS FOR THERMAL SPRAYING CYLINDRICAL BORES

[75] Inventors: Walter C. Vliet, Columbia, N.J.; Edwin E. Rice, Ann Arbor, Mich.

[73] Assignee: Ingersoll-Rand Company, Woodcliff Lake, N.J.

[21] Appl. No.: 715,722

[22] Filed: Sep. 19, 1996

[51] Int. Cl.[6] ..... H05H 1/38

[52] U.S. Cl. ..... 427/449; 427/236; 219/76.15; 219/76.16

[58] Field of Search ..... 427/449, 236; 219/76.15, 76.16

[56] References Cited

U.S. PATENT DOCUMENTS

| | | | |
|---|---|---|---|
| 5,194,304 | 3/1993 | McCune, Jr. et al. | 427/449 |
| 5,245,153 | 9/1993 | Singer et al. | 219/76.15 |
| 5,442,153 | 8/1995 | Marantz et al. | 219/76.16 |

OTHER PUBLICATIONS

"Diagnostic Behavior of the Wire–Arc–Plasma Spray Process", Kowalsky, et al, in Thermal spray: International Advances in Coating Technology Conference Proceedings, C.C. Berndt, ed., (May–Jun.) 1992, pp. 337–342.

*Primary Examiner*—Katherine A. Bareford
*Attorney, Agent, or Firm*—Walter C. Vliet

[57] ABSTRACT

Disclosed are a method and apparatus for coating the interior surface of a cylinder wherein a consumable electrode is fed to an arc formed between a rotating non-consumable electrode and directing an atomizing gas through the arc formed to carry the molten metal of the consumable electrode to the cylinder wall to coat the wall and wherein the consumable electrode is introduced into the cylinder from an end opposite the rotating non-consumable electrode.

9 Claims, 3 Drawing Sheets

METHOD AND APPARATUS FOR THERMAL SPRAYING CYLINDRICAL BORES

BACKGROUND OF THE INVENTION

This invention relates generally to thermal spraying of metallic coatings and more particularly to thermal spraying cylindrical bores for automotive engines and the like. One problem when thermal spraying cylindrical bores with a plasma arc method using wire feed as a feed stock is bringing the wire into a position that is generally central with the axis of the bore being sprayed and at the same time not having unattended wire burn back cause the arc to jump to another part of the gun head as a result of secondary arc causing damage. A second problem is feeding a non-rotating wire through the center of a rotating gun mechanism.

Several methods have been devised to reduce the possibility of an arc being transferred to part of the gun mechanism. One involves restricting the surface location of conducting gun components in relationship to the feed wire or anode so that if the wire burns back, the distance from the end of the wire to the nearest conducting gun component does not decrease causing the arc to jump to a gun component thereby causing damage.

Another method involves using electrically insulating materials for gun components that would otherwise be susceptible to "secondary arcing". Still another method is the use of an air or gas shield that prevents the arc from going outside of its normal envelope.

The above methods have disadvantages for thermal spraying guns working in a cylindrical bore where the gun rotates around a coaxially fed wire feed.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing an improved method and apparatus for thermal spraying cylindrical bores comprising a method of thermal spraying a material onto an internal cylindrical surface of a cylinder having a cylindrical axis using an arc spraying process with a consumable electrode and a non-consumable electrode, wherein the non-consumable electrode is introduced into the cylinder from one open end and is rotated within the cylinder about the cylindrical axis but offset therefrom as well as being linearly translated along the cylindrical axis; the consumable electrode being fed into and maintained in arc striking distance from the non-consumable electrode from the opposite open end of the cylinder; an arc being struck between the consumable and non-consumable electrodes and atomizing gas being directed through the arc and across the first cylindrical axis to atomize molten material in the arc and carry it towards and deposit it on the inner cylindrical surface.

Disclosed also is an apparatus for thermal spraying cylindrical bores comprising a thermal arc spray head including a non-consumable electrode disposed for rotation about and translation essentially along a central axis of a cylindrical bore; the thermal arc spray head being inserted into the cylindrical bore from one open end of the cylindrical bore and rotated about an axis of spray head rotation; a consumable electrode being inserted from an opposite open end of the cylindrical bore along the axis of spray head rotation to within arc striking distance from the non-consumable electrode; means for thereafter synchronizing the translation of the consumable and the non-consumable electrode in an arc sustaining relationship; and means associated with the non-consumable electrode for directing an atomizing gas through an arc formed and across the axis of spray head rotation to atomize molten material from the consumable electrode in the arc and carry it towards and deposit it on the inner cylindrical surface.

The foregoing and other aspects will become apparent from the following detailed description of the invention when considered in conjunction with the accompanying drawing figures:

BRIEF DESCRIPTION OF THE DRAWING FIGURES

DETAILED DESCRIPTION

Figure 1:
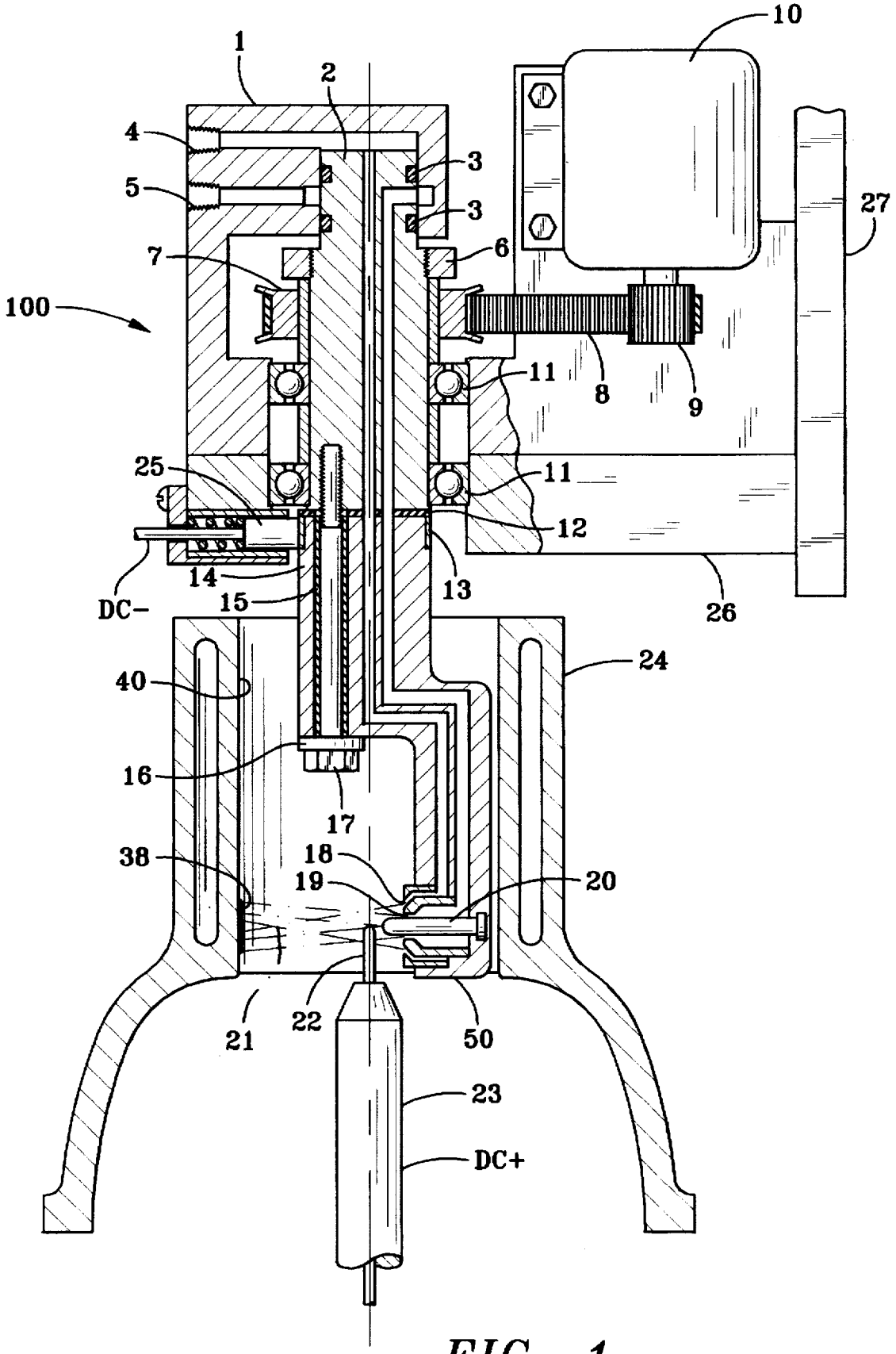
FIG. 1 is a partially sectioned elevation view of a thermal spraying apparatus according to the present invention shown in the process of coating the interior cylinder bore of an engine.

Referring to FIG. 1, a plasma arc spraying device according to the present invention is generally shown and indicated by the reference numeral 100. The arc spray unit is composed of an upper gun body 1 with an internal bore into which is disposed an upper spindle for rotation therein. The upper gun body has a supply port 4 for one process gas and a supply port 5 for a second process gas. The first one process gas is dispensed through the upper spindle 2 and the lower spindle 14 through an internal bore exiting at annular nozzle 18 for the one process gas. The second process gas entering through supply port 5 is distributed through an internal bore in the upper spindle 2 and lower spindle 14 and exits through annular nozzle 19 for the second process gas.

The upper spindle 2 is supported for rotation within the upper gun body 1 by means of a pair of spindle bearings 11 which permit the spindle to rotate within the gun body. A spindle nut 6 positions and retains a driven cog belt pulley 7 which drives the spindles 2 and 14 in rotation. The driven cog belt pulley is in turn driven by a cog belt 8 and a drive motor cog belt pulley 9 which receives its rotational input from motor 10. Rotating seal 3 isolate the first and second process gas components.

The lower spindle 14 is electrically isolated from the upper spindle 2 by means of lower spindle electrical insulator 12, insulating sleeve 15, for the attachment bolt 17 and insulating washer 16 also for the attachment bolt 17. This permits the lower spindle 14 to be electrically isolated and grounded through slip ring 13 and contact brush assembly 25. This provides a negative potential or cathode potential to non-consumable electrode 20. The lower spindle 14 is shown disposed for rotation within the cylinder bore 40 of an engine block 24. The lower spindle rotates about the centerline of the cylinder bore as indicated in FIG. 1.

According to the present invention the feed wire or consumable electrode 22 is fed through wire guide and electrical contact 23 and is impressed with the positive or anode voltage required to form an atomizing arc between the anode and the cathode in a manner well known in metal arc spraying technology. Although we have chosen to depict a gas shielded arc spray process for purposes of the preferred embodiment, it should be understood that any plasma arc or transferred arc spraying process, for example, might be utilized for production of the atomized molten metal or thermal spray material 21 which is to be deposited as a coating 38 on the cylinder wall 40.

Figure 2:
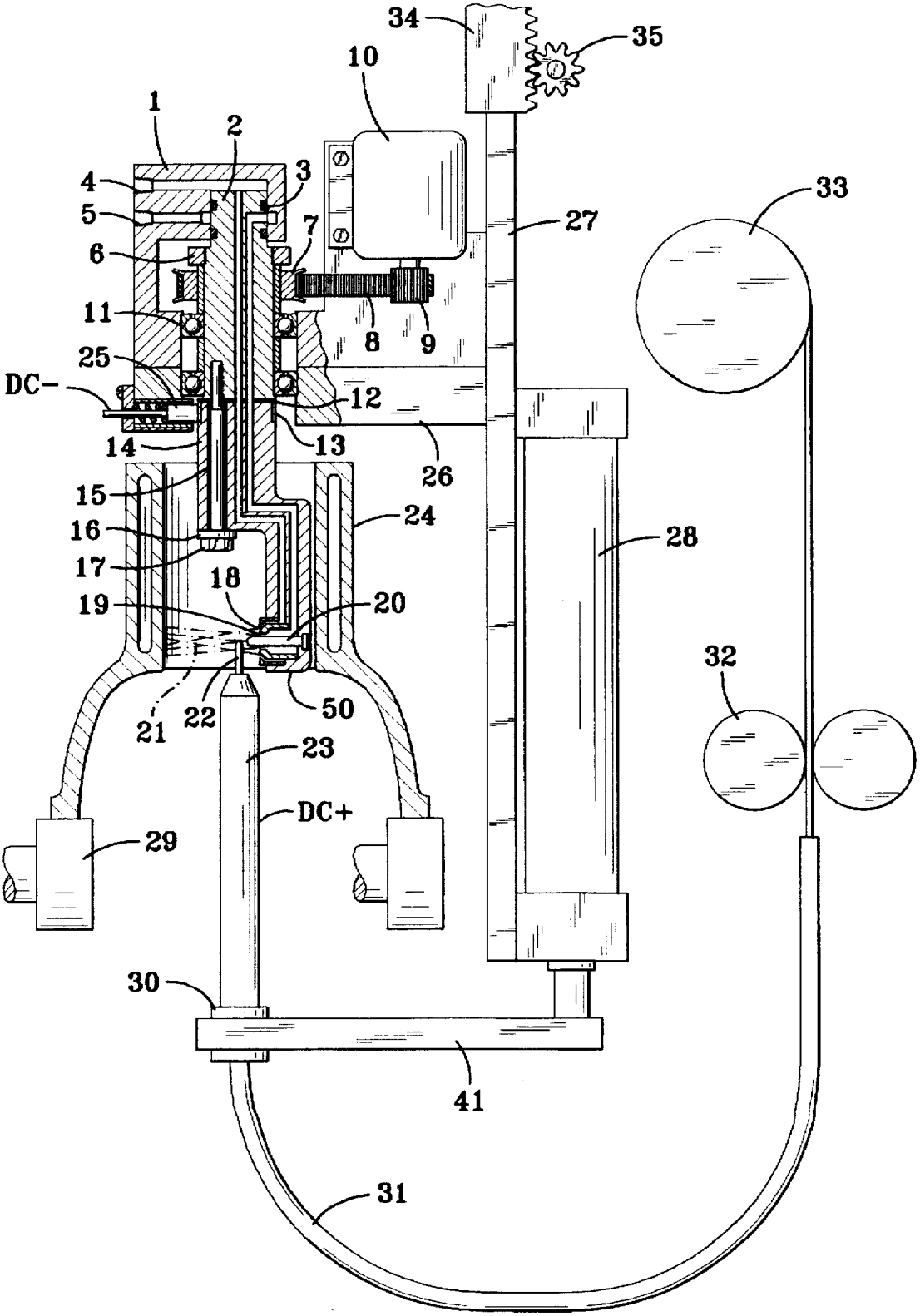
FIG. 2 is a partially sectioned elevation of a thermal spraying head and supporting transport equipment for one embodiment of the present invention.

Referring now to FIG. 2, in addition to rotation of the lower spindle, which contains the annular nozzles 18 and 19 for directing the thermal spray 21 onto the cylinder walls 40 where it is deposited as a uniform metal coating, it is also necessary to translate the nozzles vertically or axially within the cylinder bore as shown in FIG. 1. To accomplish this according to the embodiment shown in FIG. 2, the lower gun body which is attached to the upper gun body 1 and the lower spindle 14 is shown supported on a gun mounting apparatus 27 which produces an axial movement through gear rack 34 and pinion drive for the gear rack 35.

As the gun mount 27 is moved axially, it carries with it the gun body 1, 14, and 26, as well as air cylinder driven actuator 28. Attached to the air cylinder driven actuator rod is a carrier 41 which carries the insulating bushing 30 for the feed wire guide and electrical contact 23. Wire from feed wire reel 33 is fed through feed wire driving rolls 32 through the feed wire flexible conduit 31 to the feed wire guide 23 as a supply of nut wire to be deposited. The engine block 24 is shown disposed on rollers 29 for moving the engine block 24 into the thermal spray station.

Figure 3:
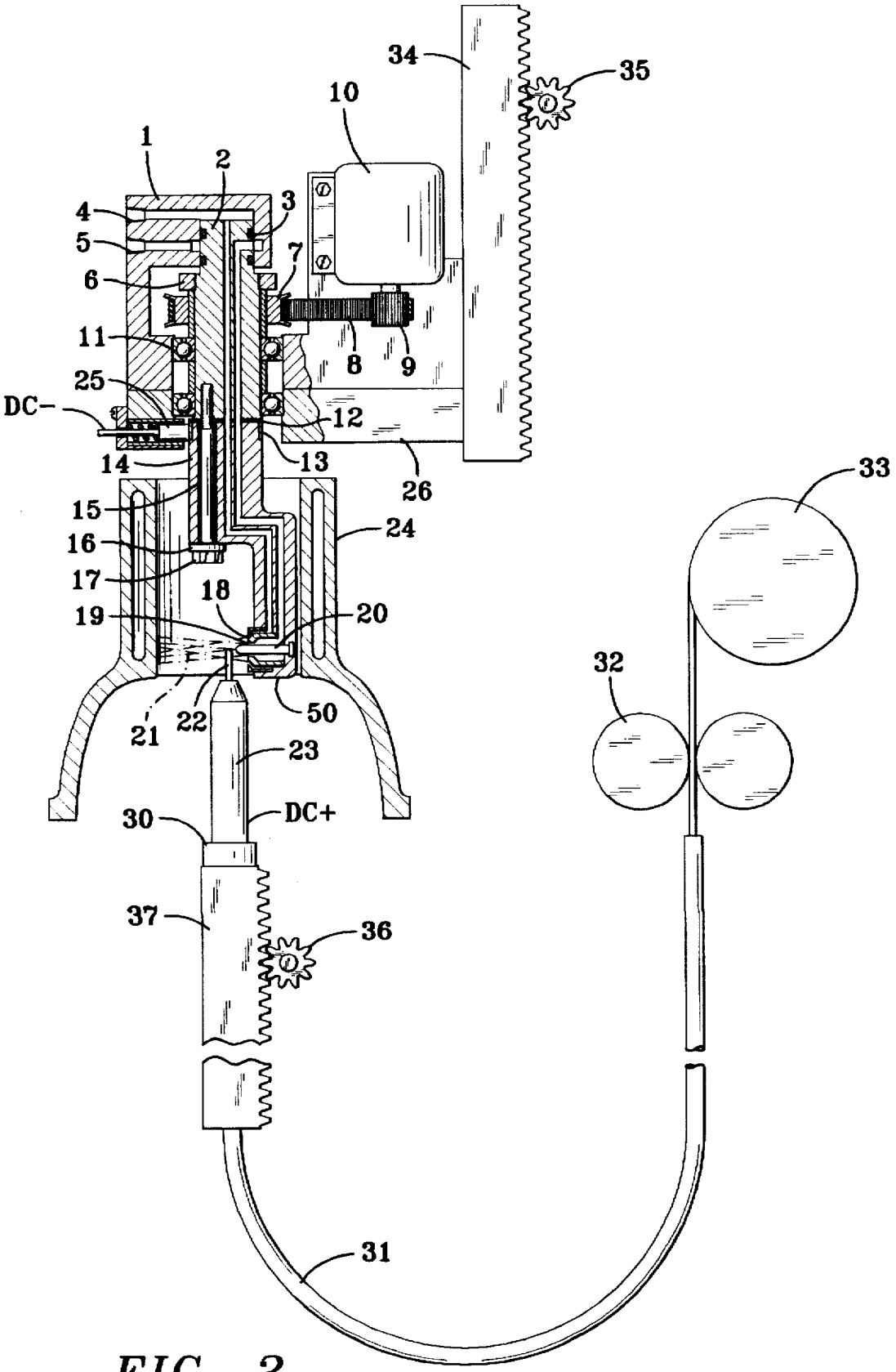
FIG. 3 is a partially sectioned elevation of the present invention showing a second embodiment of the supporting equipment.

Referring to FIG. 3, the wire feed and gear rack for gun axial motion is similar to the embodiment shown in FIG. 2 except that the wire feed guide and electrical contact 23 is independent and simultaneously driven by means of a separate pinion or servo drive for controlling position of the feed wire guide 36 and a separate servo drive rack 37. In operation in both the embodiments of FIG. 2 and FIG. 3, the arc spray process is started with the spray head 50 withdrawn from the cylinder block 24 by means of pinion 35 and rack 34 and the feed wire guide and electrical contact 23 withdrawn from the bottom of the engine block 24 by either extension of the air cylinder driven actuator, in the case of the embodiment of FIG. 2, or the independent servo pinion and rack 36,37. In this position the block 24 may be moved between the spray head 50 and the feed wire guide 23 and positioned to the centerline of a cylinder to be coated.

At this point the spray head 50 and the feed wire guide 23 may be moved into the operating juxtapose position from opposite ends of the cylinder and the spray process started by rotation of the spindle 2,14 which in turn rotates the spray head 50 about the feed wire electrode. The supply of process gas through supply ports 4 and 5 is initiated and upon electrical energization of the anode and cathode, the spray process is begun. The spray head and the feed wire guide are positioned at approximately 90 degrees from one another and are displaced axially simultaneous during the coating process to complete the coating of the interior of the cylinder wall. This is accomplished by the rack and pinion 34,35 in the case of FIG. 2 and the rack and pinion 34,35 in simultaneous conjunction with rack and pinion 36,37 in the case of the embodiment of FIG. 3.

Upon completion of the coating process the spray head 50 and the feed wire guide 23 are moved apart and in the same manner as they were moved together and the engine block 24 is indexed to the next cylinder or removed.

According to the present invention, the spray gun construction can be simpler with improved reliability by feeding the wire into the cylinder bore from the end opposite the thermal spray gun. The wire is fed in an axial direction to a position central to the cylinder bore. The end of the wire is positioned essentially at the axis of the thermal spray gun cathode. As the end of the wire is melted away, the wire feed mechanism maintains the unmelted and essentially in line with the gun cathode. As the thermal spray gun moves axially in the cylinder bore, while revolving around the axially fed wire, a means is provided to move wire guide way and the wire electrical contact in the axial direction so as to maintain the space relationship to the thermal spray gun. As shown above, this may be accomplished by mechanical linkage or by servo mechanism.

A number of advantages are obtained by the present invention. The center structure of the spray gun is free of the feed wire and wire conduit and therefore can be used for process gas coupling and passageways with a far simpler structure. If a fault would cause the feed wire to burn back it will burn away from the gun as opposed to into the gun where it could create internal problems. The anode current does not have to be fed through a slip ring device to the gun. Servicing of the gun would not involve unthreading the feed wire. The wire feed mechanism is not attached to an otherwise complicated thermal gun structure and the anode/wire guide can be serviced without disassembly of the gun.

Having described our invention in terms of a preferred embodiment, numerous other alternatives will occur to one skilled in the art. We do not wish to be limited in the scope of our invention except as claimed.

What is claimed is:

1. A method of thermal spraying a material onto a restricted access internal cylindrical surface forming a cylindrical bore of a cylinder having a first cylindrical axis of said cylindrical bore comprising:

an arc spraying process with a consumable electrode and a non-consumable electrode wherein the non-consumable electrode is introduced into the cylinder from one open end and rotated within the cylinder about the cylindrical axis but offset therefrom as well as being linearly translated along the cylindrical axis;

said consumable electrode being fed into and maintained in arc striking distance from the non-consumable electrode from an opposite open end of the cylinder;

an arc being struck between the consumable and non-consumable electrodes and atomizing gas being directed through the arc and across the first cylindrical axis to atomize molten material in the arc and carry it towards and deposit it on the internal cylindrical surface.

2. A method of thermal spraying according to claim 1 wherein:

said non-consumable electrode is part of a transferred arc plasma torch assembly which is inserted in said cylindrical bore after said cylindrical bore is positioned transversely to a cylindrical axis position in line with a rotating centerline of said torch.

3. A method of thermal spraying according to claim 2 wherein:

said consumable electrode is inserted in said cylindrical bore along said cylindrical axis after said cylindrical bore is positioned transversely to a cylindrical axis position in line with a rotating centerline of said torch.

4. An apparatus for thermal spraying cylindrical bores comprising:

a thermal arc spray head including a non-consumable electrode disposed for rotation about and translation along a central axis of a cylindrical bore; said thermal arc spray head being inserted into said cylindrical bore from one open end of said cylindrical bore;

a consumable electrode being inserted from an opposite open end of said cylindrical bore along said central axis to within arc striking distance from said non-consumable electrode;

means for thereafter synchronizing the translation of said consumable and said non-consumable electrode, in arc sustaining distance along said central axis, in an arc sustaining distance; and means associated with said non-consumable electrode for directing an atomizing gas through an arc formed and across the central axis between said consumable and said non-consumable electrode to atomize molten material from the consumable electrode in the arc and carry it towards and deposit it on an inner cylindrical surface of said cylindrical bore.

5. An apparatus for thermal spraying cylindrical bores according to claim 4 wherein:

said thermal arc spray head is a transferred arc plasma torch assembly containing said non-consumable electrode.

6. An apparatus for thermal spraying cylindrical bores according to claim 4 wherein:

said thermal arc spray head and said consumable electrode are mounted on a common reciprocating carrier and are axially aligned and relatively displaceable in opposite directions to permit insertion of a cylindrical bore therebetween.

7. An apparatus for thermal spaying cylindrical bores according to claim 4 wherein:

said thermal arc spray head and said consumable electrode are mounted on coordinated servo means for alternatively moving said thermal arc spray head and said consumable electrode together and apart or coordinated together to reciprocate within said cylindrical bore.

8. An apparatus for thermal spraying cylindrical bores according to claim 4 further comprising a means for moving said cylindrical bore transversely to a position of alignment of the central axis of the cylindrical bore with a rotating axis of said thermal arc spray head.

9. An apparatus for thermal spraying cylindrical bores according to claim 4, wherein:

said cylindrical bore is a piston bore in an engine block.

* * * * *